United States Patent [19]

Norris

[11] Patent Number: 4,708,286

[45] Date of Patent: Nov. 24, 1987

[54] MAIL-CALL SIGNAL DEVICE

[76] Inventor: James E. Norris, 3 Suzette Dr., Springfield, Ill. 62702

[21] Appl. No.: 941,688

[22] Filed: Dec. 15, 1986

[51] Int. Cl.[4] ..... A47G 29/12

[52] U.S. Cl. ..... 232/35

[58] Field of Search ..... 232/34, 35

[56] References Cited

U.S. PATENT DOCUMENTS

| | | | |
|---|---|---|---|
| 2,808,982 | 10/1957 | Armstrong | 232/35 |
| 3,709,189 | 1/1973 | Widham | 232/35 |
| 4,247,039 | 1/1981 | Cornwell | 232/35 |
| 4,363,439 | 12/1982 | Manian | 232/35 |
| 4,382,542 | 5/1983 | Farris | 232/35 |

*Primary Examiner*—Robert W. Gibson, Jr.

[57] ABSTRACT

A mail-call signal device secured to the exterior of a typical rural or curbside mailbox door to indicate the presence of mail. When the mail carrier opens the mailbox door the face plate and signal plate rotate downward permitting the bright orange signal plate to be thrust outward and downward by spring means to a fully extended position visible from all directions. The signal device is reset with one finger applying pressure to the bottom of the signal plate in the upward position.

9 Claims, 5 Drawing Figures

MAIL-CALL SIGNAL DEVICE

BACKGROUND OF THE INVENTION

There is a need for a simple and durable signal device to alert patrons to the presence of mail. The present invention relates to a mail-call signal device for use on rural and curbside mailboxes to alert the patrons that mail has been received, thereby rendering it unnessary for them to waste valuable time by walking to an empty mailbox. In addition, because rural mailboxes are mounted with the view of the door either facing or not facing the line of sight of the patron, it is important that the mail-call signal device be visible from the front or back view.

SUMMARY OF THE INVENTION

The present invention relates to a mail-call signal device secured to the mailbox door by double sided adhesive tape. The apparatus consists of an anchor plate, face plate, and signal plate hinged to each other with the anchor plate secured to the mailbox door. When the mailbox door is opened the face plate and signal plate will rotate outward by force of gravity about their longitudinal axis away from the mailbox door. When this occurs the two plates will separate and unfold to the completely open position. revealing a signal plate that is bright orange on both sides, hanging below the bottom of the mailbox, thereby permitting it to be seen from all directions, and a face plate with its exterior side exposed displaying an indicia identifying the patron. The mail-call signal device can be reset with only one finger applying force to the bottom of the signal plate in the upward direction, enfolding the orange signal plate between the face plate and mailbox door. This feature can be appreciated in that many patrons pick up mail from their car window, almost always from the wrong side of the road, and have only one hand available for the operation of the mailbox door.

BRIEF DESCRIPTION OF THE DRAWINGS

The instant invention is readily understood by examining the apparatus in four different positions-closed, activated, signal, and reset. The four positions are shown in figures one through four. A fifth figure shows an underside view of the invention.

DESCRIPTION OF PREFERRED EMBODIMENTS

Figure 1:
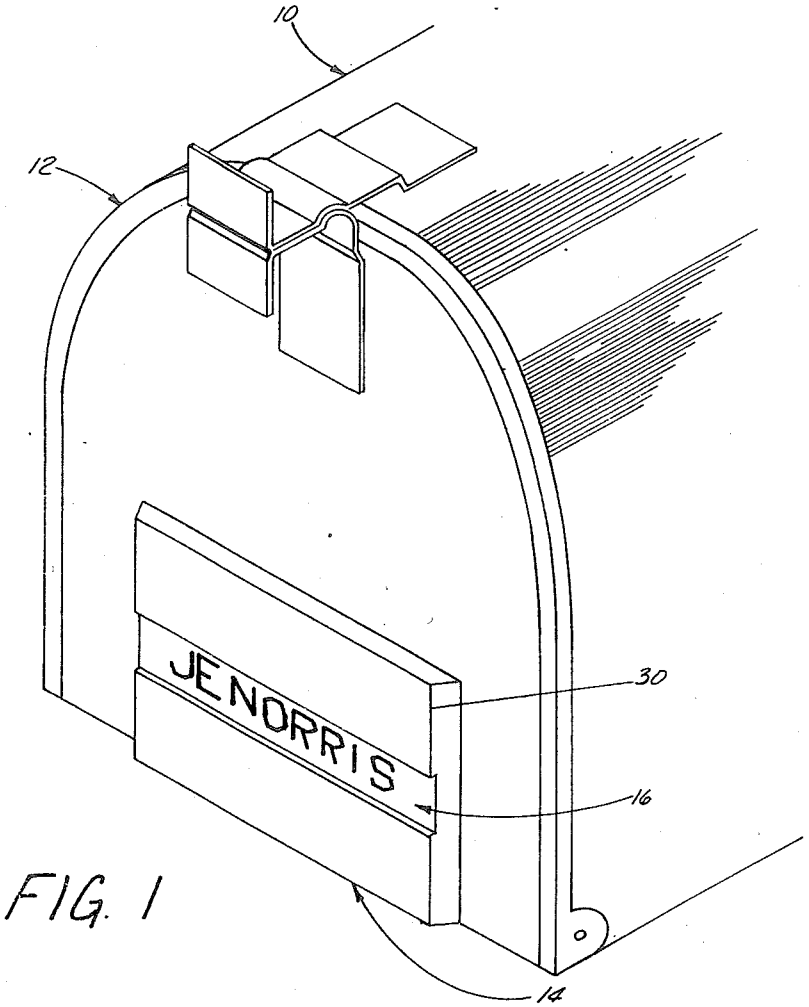
FIG. 1 is a perspective front view of a rural mailbox door depicting the instant invention in the closed position with the signal plate completely obscured from view and the face plate diplaying an indicia identifying the patron.

The drawings shown in FIGS. 1 through 5 depict a typical rural or curbside mailbox 10 with the mail-call signal device 14 secured to the mailbox door 12 by a strip of adhesive 22 applied between mailbox door 12 and anchor plate 20. FIG. 1 shows the mail-call signal device in the closed position with the orange signal plate 40 enfolded between face plate 30 and mailbox door 12 shielding completely the orange signal plate 40 from being visible and thereby preventing a false signal of the presence of mail. The exterior side of face plate 30 will be visisible in the closed and opened positions permitting an indicia 16 displaying letters identifying the patron.

Figure 2:
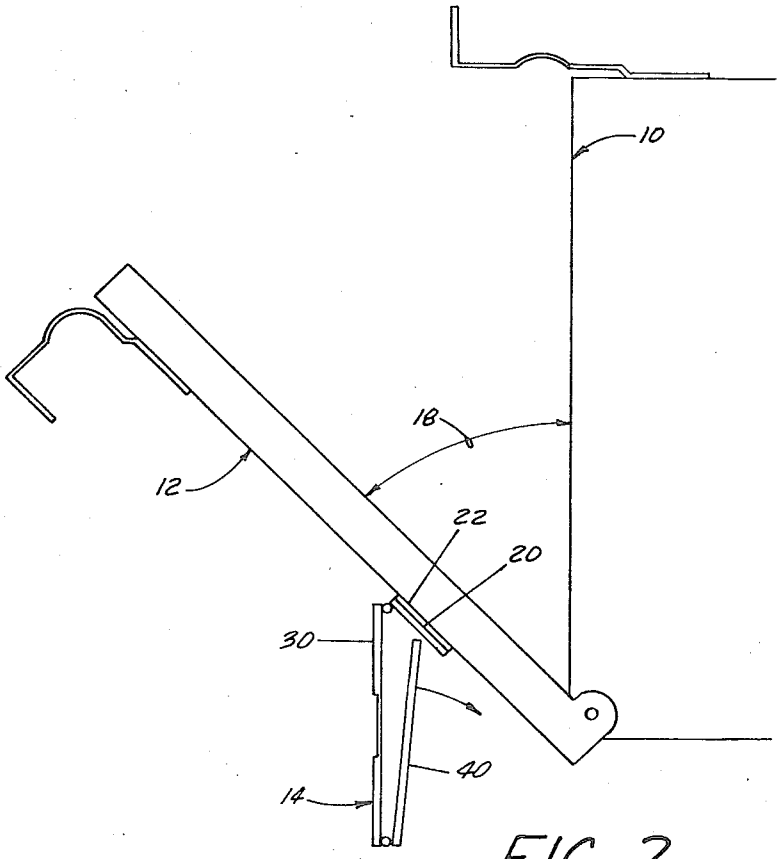
FIG. 2 is a side view of the mailbox door in a partially open or activated position depicting how the mailbox door must be opened more than halfway before the signal plate will unfold completely.

FIG. 2 depicts anchor plate 20 hinged to the top of face plate 30 and signal plate 40 hinged to the bottom of face plate 30. When the mailbox door 12 is opened, gravity forces mailbox signal device 14 to rotate outward and away from the mailbox door 12. As the rotation continues the orange signal plate 40 is forced by spring 36 shown in FIG. 5 to separate from face plate 30 and rotate downward 180 degrees. The signal plate will open only to 180 derees with respect to the face plate. It can be appreciated that the weight of the mail-call signal device plates 30 and 40 in the closed position will ensure that if the mailbox door 12 is left partially open the mail-call signal device 14 will not open prematurely until the angle formed between the mailbox door 12 and the mail-call signal device 14 is greater than 50 degrees 18.

Figure 3:
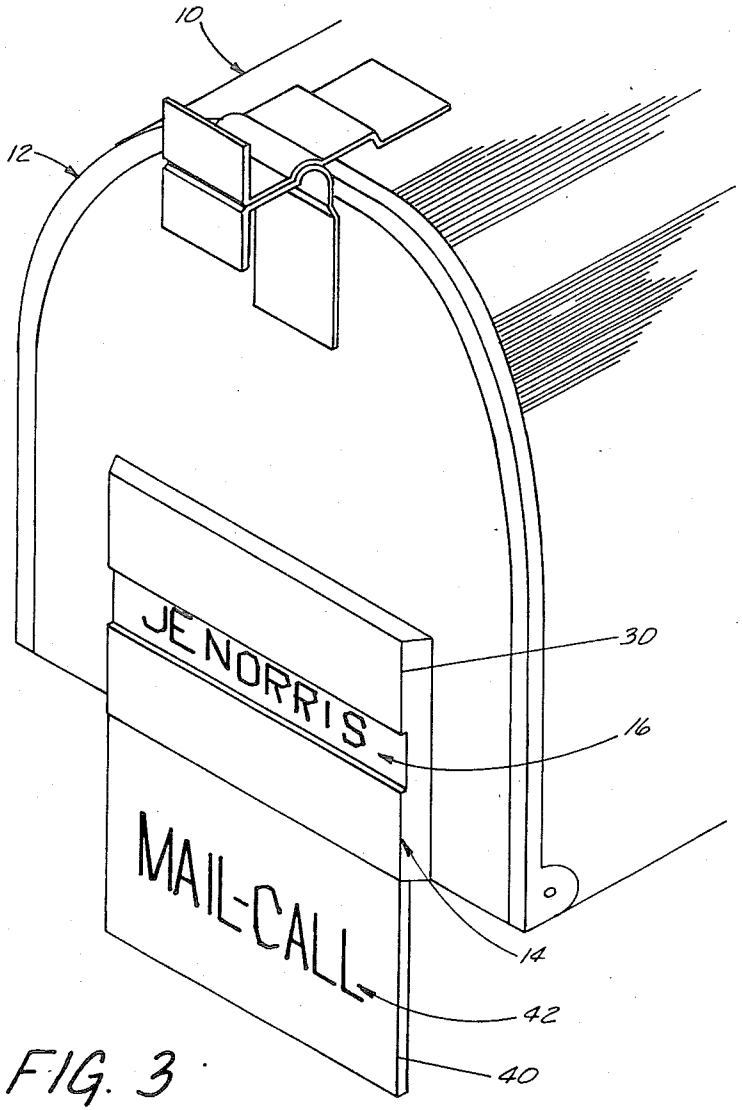
FIG. 3 is a perspective front view depicting the mail-call signal device in the signal position with the signal plate fully extended, permitting it to be viewed from all directions and displaying an imprinted indicia, 'MAIL-CALL'.

As shown in FIG. 3 when the mailbox door 12 is returned to the closed position the orange signal plate 40 will remain in the fully extended position and be clearly visible from all directions to indicate the presence of mail and display an imprinted indicia 42 'MAIL-CALL'.

Figure 4:
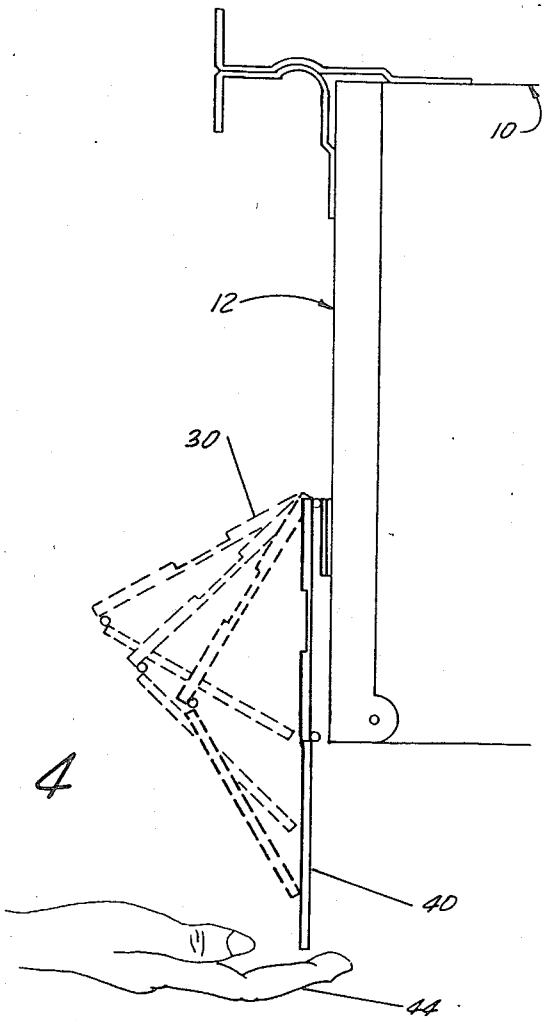
FIG. 4 is a side view depicting the mail-call signal device in a partially closed or reset position caused by the upward force applied by one finger at the bottom of the signal plate.

As shown in FIG. 4 when mail is removed from mailbox 10 the patron can with one finger 44 reset the mail-call signal device to the closed position. This operation is made possible because signal plate 40 will operate in only one direction when pressure is applied upward from the bottom of signal plate 40. The applied pressure forces signal plate 40 to move face plate 30 outward and upward until signal plate 40 is completely enfolded between face plate 30 and anchor plate 20. The importance of this feature can be appreciated because the patrons, whether walking or picking up mail from their car window, have only one hand available for operation of the mailbox signal device 14.

Figure 5:
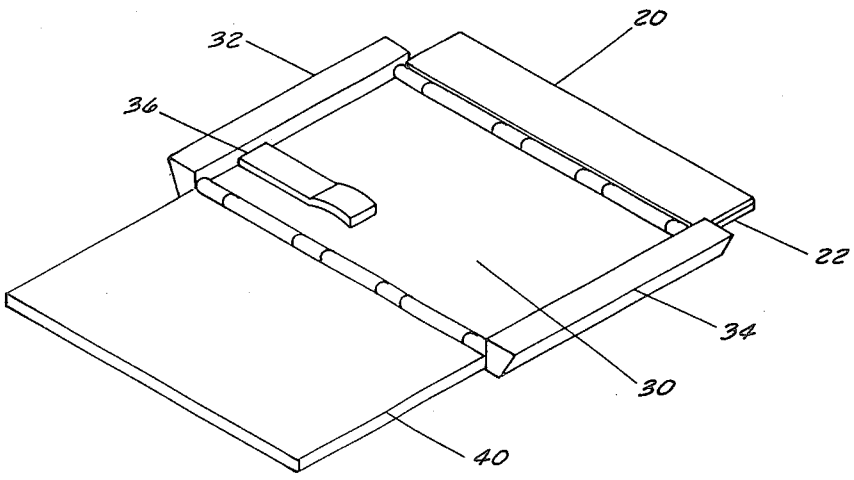
FIG. 5 is a perspective underside view of the invention showing a spring mounted between the signal plate and the face plate that ensures the separation of the two plates when the mailbox door is opened. Also shown are two elongated beveled side plates that are part of the face plate and are used to prevent strong winds from prematurely activating the mailbox signal device.

FIG. 5 depicts two elongated plate 32s and 34 extended perpendicular to the interior side and part of face plate 30. These elongated plates are beveled on the exterior side at 30 degree angles. When the wind blows at high velocity from either side of the mail-call signal device 14 while in the closed position, this 30 degree angle causes face plate 30 to operate like a rudder and forces the mail-call signal device 14 against the mailbox door 12 rather than out and away from the mailbox door 12 thereby, preventing the orange signal plate 40 from activating and causing a premature signal.

The preceding detailed description and drawings explained the preferred embodiments of the invention. It is understood that there can be modifications and substitutions made for these embodiments without detracting from the basic concept of said invention and contemplates any configuration and design of components which will accomplish the equivalent result.

I claim:

1. A mail-call signal device for use with a mailbox having a front door pivotally mounted at the bottom of said mailbox, wherein said mail-call signal device is secured to the exterior side of said mailbox door comprising:

(a) an anchoring member mounted on the exterior side of said mailbox door used to secure said mail-call signal device to said mailbox door to permit the movement of said device between the closed position to indicate the absence of mail and the open position to indicate the presence of mail;

(b) a face panel pivotally mounted at the top of said anchoring member which pivots out and away from said anchoring member when said mailbox door is opened and returns to the original position when said mailbox door is closed, thereby always revealing the exterior side of said face panel;

(c) a signal panel hingedly mounted to the bottom of said face panel which pivots downward and away from said face panel when said mailbox door is opened to a fully extended vertical position below said mailbox door visible from all directions to indicate the presence of mail and remains fully extended when said mailbox door is closed;

(d) a spring means located between said face panel and said signal panel to actuate said signal panel to move away from said face panel when said mailbox door is opened, ensuring that said signal panel will always be thrust away from said face panel so the force of gravity can pull it down, wherein said spring member also ensures that on extremely humid days said signal panel does not stick to said face panel while in the closed position caused by the suction effect of water droplets preventing said signal panel from moving in the downward direction.

2. The mail-call signal device of claim 1 further comprises said anchoring member permanently mounted on the exterior side of said mailbox door with an adhesive strip thereby ensuring said mail-box signal device will not be stolen.

3. The mail-call signal device of claim 1 further comprises said signal device designed to operate only when said mailbox door is opened to an angle greater than 50 degrees from the perpendicular before said mail-call signal device is activated.

4. A mail-call signal device for use with a mailbox having a front door pivotally mounted at the bottom of said mailbox, wherein said mail-call signal device is secured to the exterior side of said mailbox door comprising:

(a) an anchoring member mounted on the exterior side of said mailbox door used to secure said mail-call signal device to said mailbox door to permit the movement of said device between the closed position to indicate the absence of mail and the open position to indicate the presence of mail;

(b) a face panel pivotally mounted at the top of said anchoring member which pivots out and away from said anchoring member when said mailbox door is opened and returns to the original position when said mailbox door is closed, thereby always revealing the exterior side of said face panel;

(c) a signal panel hingedly mounted to the bottom of said face panel which pivots downward and away from said face panel when said mailbox door is opened to a fully extended vertical position below said mailbox door visible from all directions to indicate the presence of mail and remains fully extended when said mailbox door is closed, wherein said signal panel will abut to said face panel when opened to 180 degrees, whereby said signal panel will operate in only one direction and may be reset by applying force to the bottom of said signal panel in the upward direction, completely enfolding said signal panel between said face panel and said mailbox door;

(d) a spring means operating between said face panel and said signal panel to actuate said signal panel to move away from said face panel when the mailbox door is opened.

5. The mail-call signal device of claim 4 further comprises said signal panel completely obscured from view in the closed position, thereby preventing an erroneous signal, whereby said signal panel may be a bright color on both sides, allowing said signal panel to be visible from any direction only when said mail-call signal device is fully activated.

6. The signal panel of claim 5 further comprises an indicia 'MAIL-CALL', inprinted on said signal panel.

7. A mail-call signal device for use with a mailbox having a front door pivotally mounted at the bottom of said mailbox, wherein said mail-call signal device is secured to the exterior side of said mailbox door comprising:

(a) an anchoring member mounted on the exterior side of said mailbox door used to secure said mail-call signal device to said mailbox door to permit the movement of said device between the closed position to indicate the absence of mail and the open position to indicate the presence of mail;

(b) a face panel pivotally mounted at the top of said anchoring member which pivots out and away from said anchoring member when said mailbox door is opened and returns to the original position when said mailbox door is closed, thereby always revealing the exterior side of said face panel, said face panel including two elongated edge portions extending perpendicularly to the interior side of said face panel, said edge portions being beveled on the exterior sides thereof at 30 degree angles with respect to the exterior of said face panel, permitting said mail-call signal device to operate like a rudder while in the closed position, whereby when wind blows at high velocity across said mail-call signal device from either side, said mail-call signal device is forced toward said mailbox door rather than up and away from said mailbox door, thereby preventing the premature activation of said signal panel, wherein said side panels also act to keep dirt, water and snow from forming on the inside of said mail-call signal device;

(c) a signal panel hingedly mounted to the bottom of said face panel which pivots downward and away from said face panel when said mailbox door is opened to a fully extended vertical position below said mailbox door visible from all directions to indicate the presence of mail and remains fully extended when said mailbox door is closed;

(d) a spring means operating between said face panel and said signal panel to actuate said signal panel to move away from said face panel when the mailbox door is opened.

8. The mail-call signal device of claim 7 further comprises said face panel hingedly secured to said anchor panel and signal panel whereby the exterior side of said face panel will always be visible in the closed and open positions.

9. The face panel of claim 8 further comprises a groove on the exterior of said face panel as a means for locating letters identifying the patron, whereby said letters will always be visible in both the closed and open positions of said mailbox door.

* * * * *